US011802380B2

(12) United States Patent
Wollanek et al.

(10) Patent No.: US 11,802,380 B2
(45) Date of Patent: Oct. 31, 2023

(54) TRACK MAINTENANCE MACHINE HAVING A TRACK POSITION MEASURING SYSTEM

(71) Applicant: PLASSER & THEURER EXPORT VON BAHNBAUMASCHINEN GESELLSCHAFT M.B.H., Vienna (AT)

(72) Inventors: Samuel Wollanek, Pregarten (AT); Leopold Fruehwirt, Pregarten (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 1218 days.

(21) Appl. No.: 16/346,555

(22) PCT Filed: Oct. 5, 2017

(86) PCT No.: PCT/EP2017/001174
§ 371 (c)(1),
(2) Date: May 1, 2019

(87) PCT Pub. No.: WO2018/082796
PCT Pub. Date: May 11, 2018

(65) Prior Publication Data

US 2019/0257038 A1 Aug. 22, 2019

(30) Foreign Application Priority Data

Nov. 4, 2016 (AT) ..... A 505/2016

(51) Int. Cl.
*E01B 35/08* (2006.01)
*E01B 27/17* (2006.01)
(Continued)

(52) U.S. Cl.
CPC ..... *E01B 35/08* (2013.01); *E01B 27/17* (2013.01); *E01B 35/00* (2013.01); *E01B 35/10* (2013.01); *E01B 35/12* (2013.01); *E01B 27/16* (2013.01)

(58) Field of Classification Search
CPC ..... E01B 35/00; E01B 35/06; E01B 35/08; E01B 35/10; E01B 35/12
(Continued)

(56) References Cited

U.S. PATENT DOCUMENTS 2,784,496 A * 3/1957 Rousse ..... B61K 9/08 33/331
2,832,148 A * 4/1958 Rousse ..... B61K 9/08 33/523.2
(Continued)

FOREIGN PATENT DOCUMENTS

| | | |
|---|---|---|
| AT | 314579 B | 4/1974 |
| AT | 382410 B | 2/1987 |
| EP | 1650348 A2 | 4/2006 |

*Primary Examiner* — George B Bennett
(74) *Attorney, Agent, or Firm* — Laurence A. Greenberg; Werner H. Stemer; Ralph E. Locher

(57) ABSTRACT

A track maintenance machine for carrying out track position corrections includes a machine frame movable by on-track undercarriages on rails of a track and a track position measuring system having two outer measuring devices and a central measuring device with a common reference base, relative to a longitudinal direction of the machine. The measuring devices are defined in their position relative to the rails. Two mutually aligned measuring chords are tensioned or stretched as a reference base between the outer measuring devices. The central measuring device includes a measuring transducer for detecting position data of the two measuring chords. The position data are fed to an evaluation device in order to determine a longitudinal level for each rail and a versine. Thus, two measuring chords are sufficient to detect
(Continued)

all of the track parameters. A method for operation of a track maintenance machine is also provided.

15 Claims, 2 Drawing Sheets

(51) Int. Cl.

| | |
|---|---|
| ***E01B 35/10*** | (2006.01) |
| ***E01B 35/12*** | (2006.01) |
| ***E01B 35/00*** | (2006.01) |
| *E01B 27/16* | (2006.01) |

(58) Field of Classification Search
USPC ..... 33/1 Q, 521, 523.1, 523.2
See application file for complete search history.

(56) References Cited

U.S. PATENT DOCUMENTS

| | | | | |
|---|---|---|---|---|
| 3,706,284 | A | 12/1972 | Plasser et al. | |
| 4,655,142 | A | 4/1987 | Theurer et al. | |
| 5,199,176 | A * | 4/1993 | Theurer | B61K 9/08 33/651.1 |
| 6,415,522 | B1 * | 7/2002 | Ganz | B61K 9/08 33/1 Q |
| 6,618,954 | B2 * | 9/2003 | Kumazawa | G01B 21/30 73/146 |
| 6,725,782 | B1 * | 4/2004 | Bloom | E01B 35/00 105/157.1 |
| 6,976,324 | B2 * | 12/2005 | Theurer | E01B 35/06 701/28 |
| 7,181,851 | B2 | 2/2007 | Theurer et al. | |
| 10,619,313 | B2 * | 4/2020 | Fruehwirf | E01B 35/06 |
| 11,078,631 | B2 * | 8/2021 | Gilbert | B61K 9/10 |
| 11,268,247 | B2 * | 3/2022 | Hamilton | E01B 29/26 |
| 2021/0269075 | A1 * | 9/2021 | Takewa | E01B 35/06 |

* cited by examiner

TRACK MAINTENANCE MACHINE HAVING A TRACK POSITION MEASURING SYSTEM

FIELD OF THE INVENTION

The invention relates to a track maintenance machine for carrying out track position corrections, including a machine frame mobile by means of on-track undercarriages on rails of a track and a track position measuring system which comprises, with regard to a longitudinal direction of the machine, two outer measuring devices and a central measuring device with a common reference base, wherein the measuring devices are defined in their position relative to the rails. The invention further relates to a method for operation of such a track maintenance machine.

DESCRIPTION OF THE RELATED ART

In EP 1 650 348 A2, a track maintenance machine designed as a cleaning machine is described. The latter comprises a track position measuring system having as reference base two measuring chords arranged one following the other. By means of the front measuring chord, the track position is detected prior to a cleaning procedure. After the cleaning procedure, a track position correction takes place by means of the second measuring chord. In this, the track position is replicated on the basis of the versine. Longitudinal levels of the rails are not taken into account.

A track maintenance machine designed as a track tamping machine is known from patent AT 382 410 B. Here, a measuring chord is associated as reference base with each rail of a track. In this, the particular rail position is detected by means of outer measuring devices and transmitted via adjustable linkages to the corresponding measuring chord. In this way, the measuring chords serve to define a respective rail longitudinal level (vertical position) in the region of a central measuring device. To that end, fork-like feeler members of the central measuring device trace the position of both measuring chords. In this solution, sufficient free space must be available for the measuring chords arranged in the upper region of the machine and for the transmission linkages.

SUMMARY OF THE INVENTION

It is the object of the invention to provide an improvement over the prior art for a track maintenance machine and a method of the type mentioned at the beginning.

According to the invention, this object is achieved by way of the independent claims. Dependent claims indicate advantageous embodiments of the invention.

In this, two measuring chords aligned with one another are stretched as reference base between the outer measuring devices, wherein the central measuring device comprises a measuring transducer for detecting position data of the two measuring chords, and wherein the position data are fed to an evaluation device in order to determine a longitudinal level for each rail and a versine. Thus, two measuring chords are sufficient to detect all of the track parameters. Via a detected twisting, both rail longitudinal levels can be determined. Detection of the lateral position of the measuring chords yields the versine, wherein a redundancy exists based on the two measuring chords.

In an advantageous embodiment of the invention, the two measuring chords are aligned parallel to one another when the outer measuring devices are in a neutral position. The evaluation of the rail vertical levels takes place based on the distance between the measuring chords in the region of the central measuring device. Due to the measuring chords being parallel, this distance is defined in a simple manner. In addition, a structurally identical measuring chord clamping device is arranged at both outer measuring devices.

It is further advantageous if each outer measuring device comprises an inclinometer. In the simplest case, this is a pendulum by means of which a super-elevation is detected in the region of the particular measuring device. With this, the evaluation of the detected measuring chord position data is significantly simplified in that a compensation of the respective super-elevation takes place.

A further simplification provides that each outer measuring device comprises an inclination compensation device in order to keep the two measuring chords in position with respect to an axis of rotation extending in the longitudinal direction of the machine. With this, a transverse inclination of the central measuring device can be derived directly from the detected position data of the measuring chords, since super-elevations in the region of the outer measuring devices are compensated mechanically.

The evaluation is simplified yet again if each outer measuring device comprises a lateral guiding device in order to keep the measuring chords in the track center in the region of the central measuring device during travel in a curve. In this, the ends of the measuring chords are displaced in lateral direction, wherein the versine of the track results from the displacement paths and the measuring chord position data. In addition, there is no danger of the measuring chords colliding with any work units in the region of the central measuring device.

For reliable detection of the position data, it is advantageous if the measuring transducer is designed as an optical measuring sensor. This is, for example, a laser line sensor which is available in a robust industrial design and possesses sufficient measurement precision.

In a favourable embodiment of the invention, each measuring device is designed as a rail-guided measuring trolley. Thus, the position of the measuring devices relative to the rails is defined by means of flanged rollers designed to be pressed laterally against the rails.

An alternative embodiment provides that at least one measuring device is designed as a measuring platform which is arranged on an on-track undercarriage or on the machine frame and comprises two position measuring sensors, each associated with one rail. In this, structural components prone to wear, such as flanged rollers, are eliminated, and determining the position of the measuring device relative to the rails takes place in a very precise manner.

In a design of the track maintenance machine as a track tamping machine, it is useful if the central measuring device is arranged on a track lifting- and lining unit which is displaceable relative to the machine frame. In this way, the central measuring device is kept in the track center.

For an increase in measurement precision, the two measuring chords are aligned with respect to a laser beam emitted or received by the track maintenance machine. With this, the reference base can be elongated in a simple manner.

Additionally, it is favourable if the evaluation device comprises a low pass filter to filter out vibrations of the respective measuring chord. With this, interfering vibrations are masked which are caused, for example, by working units of the track maintenance machine.

The method according to the invention provides that the position of the measuring chords in the region of the central measuring device is detected by means of the measuring transducer, and that the longitudinal level for each rail and the versine are computed by means of the evaluation device. Thus, all track parameters can be determined with a few method steps.

In this, it is useful if an inclination is detected for each outer measuring device and included in the computation. Detecting the position at one point of the respective measuring chord by means of the measuring transducer is then sufficient.

In a further embodiment of the method, it is provided that a lateral displacement is detected for each outer measuring device and included in the computation. Thus, the measuring chords remain positioned in the track center in the area of the central measuring device.

A further improvement of the method exists if, by means of the evaluation device, vibrations of the particular measuring chord above a prescribed limit frequency are attenuated. For defining the limit frequency, typical vibration frequencies of work units are referred to.

BRIEF DESCRIPTION OF THE SEVERAL VIEWS OF THE DRAWING

The invention will be described by way of example below with reference to the attached figures. There is shown in schematic representation in.

DESCRIPTION OF THE INVENTION

Figure 1:
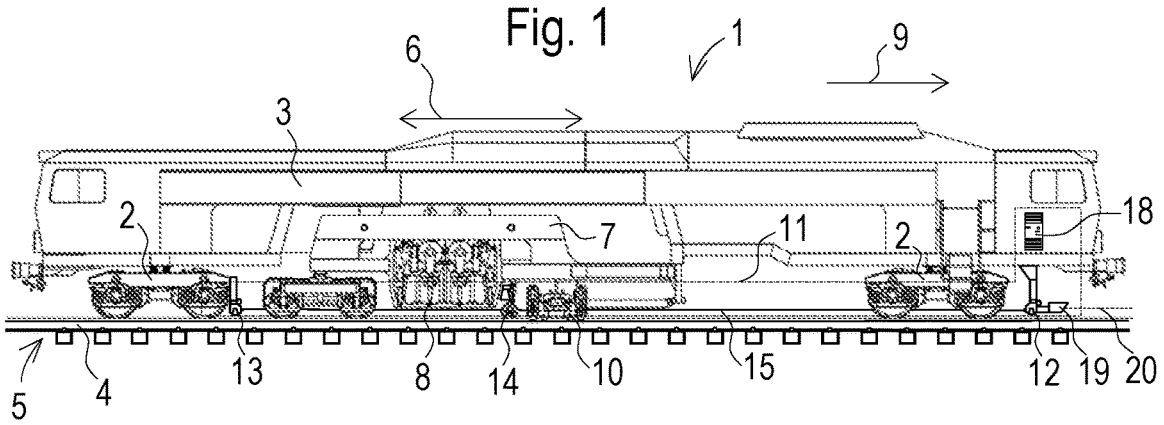
FIG. 1 a track maintenance machine in a side view
FIG. 2 components of the track measuring system
FIG. 3 a track measuring system in a side view
FIG. 4 a detail of an outer measuring device
FIG. 5 geometric relationships

A track maintenance machine 1, shown in FIG. 1, for carrying out track position corrections has a machine frame 3 supported on on-track undercarriages 2 and is mobile on rails 4 of a track 5. Arranged between the two on-track undercarriages 2 is a satellite frame 7 which is displaceable relative to the machine frame 3 in a longitudinal direction 6 of the machine. Connected to this satellite frame 7 as working units are a tamping unit 8 for tamping the track 5 and, immediately preceding the same in a working direction 9, a track lifting- and lining unit 10.

For determining track position faults, a track measuring system 11 is provided. This comprises, with regard to the longitudinal direction 6 of the machine, two outer measuring devices 12, 13 which can be seen in the working direction 9 as a front measuring device 12 and a rear measuring device 13. Arranged there between is a central measuring device 14 for detecting the track position in the region of the working units 8, 10. As a common reference base 15, a first measuring chord 16 and a second measuring chord 17 aligned thereto are stretched between the two outer measuring devices 12, 13.

In an advantageous embodiment, the alignment of the two measuring chords 16, 17 takes place in the manner that the ends thereof are clamped at the respective measuring device 12, 13 at the same distance to one another in one plane. Thus, in a neutral (torsion-free) position of the outer measuring devices 12, 13, the measuring chords 16, 17 extend parallel to one another.

Further, the track measuring system 11 comprises an evaluation device 18 which is designed, for example, as a computer and connected to the measuring devices 12, 13 via a bus system. Optionally, a laser receiver 19 is arranged at the front measuring device 12 in order to receive a laser beam 20. The latter is emitted by a remote reference transmitter to elongate the reference base 15.

Figure 2:
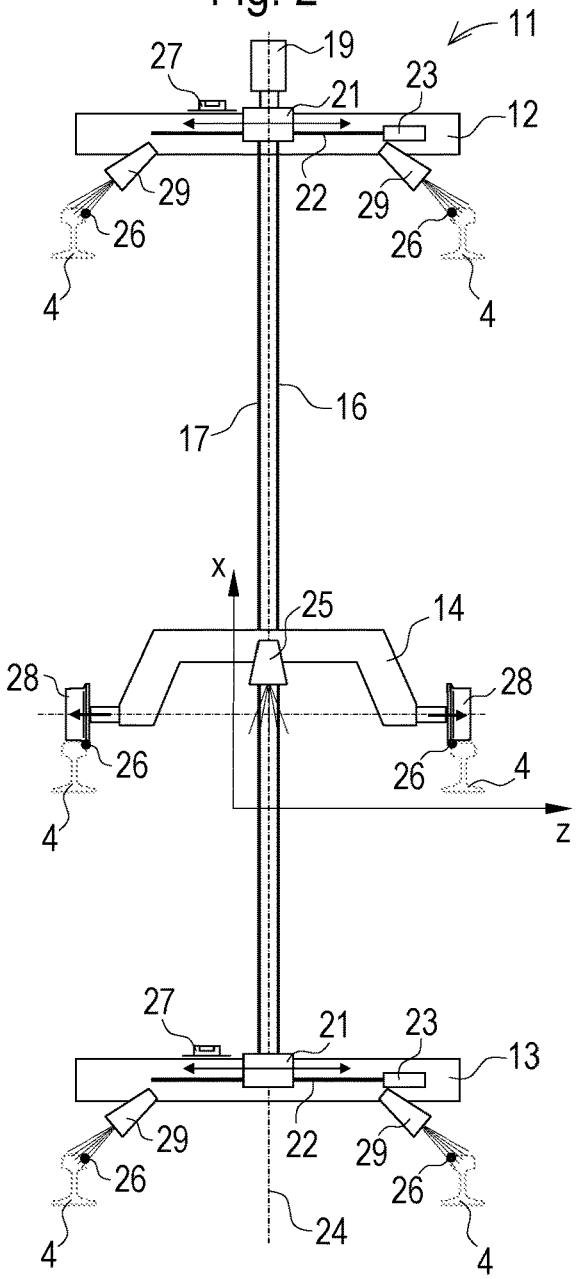

In FIG. 2, the two measuring chords 16, 17 are arranged parallel to one another in a horizontal plane. They are clamped in a laterally displaceable manner at the two outer measuring devices 12, 13. To that end, for example, a respective clamping device 21 is connected via a spindle 22 to a motor 23. A lateral displacement takes place during travel in curves in order to keep the measuring chords 16, 17 in the track center 24 in the region of the central measuring device 14. The motors 23 are controlled in dependence on the evaluation of the measuring chord position which is detected by means of a measuring transducer 25 arranged on the central measuring device 14.

Favourably, the measuring transducer 25 is designed as a laser line scanner and detects the position of the measuring chords 16, 17 in a horizontal direction and a vertical direction. Thus, two coordinate axes z, y are defined for determining rail measuring points 26 in a three-dimensional coordinate system. The third coordinate axis x defines the position of the particular rail measuring point 26 in the longitudinal direction 6 of the machine. To that end, the known distances of the measuring devices 12, 13, 14 to one another are used, and the data of an odometer are evaluated.

Arranged at the outer measuring devices 12, 13 in each case is an inclinometer 27. With this, the respective inclination of the associated measuring device 12, 13 in a super-elevation of the track 5 is detected and included in the computation of the track position. Favourably, an inclination compensation of the outer measuring devices 12, 13 takes place. Then the measuring chords 16, 17 always remain aligned in one plane, so that the inclination of the central measuring device 14 can be derived directly from the position measurement of the two measuring chords 16, 17.

In the example of embodiment according to FIG. 2, the central measuring device 14 is configured as a measuring trolley. Guiding along the respective rail edge takes place by means of two flanged rollers 28 which are pressed against the inner rail surfaces to prevent play. The position of the rail measuring points 26 is detected at the respective rail edge. During a forward motion of the track maintenance machine 1, the track position is determined on the basis of the changing rail measuring points 26. One of the flanged rollers 28 can additionally be used as a path measuring wheel for path measurement.

The two outer measuring devices 12, 13 are designed as measuring platforms contact-free relative to the rails 4. In this, a position measuring sensor 29 is directed at each rail 4 in order to detect the position of the respective measuring platform relative to each rail 4. Here also, laser line scanners are favourably used.

The outer measuring devices 12, 13 are mounted either on the machine frame 3 or on the front or rear on-track undercarriage 2. The latter case requires a modified clamping device 21 with a length compensation for the measuring chords 16, 17 during travel in a curve. Alternatively, all of the measuring devices 12, 13, 14 can also be designed as measuring trolleys.

Figure 3:
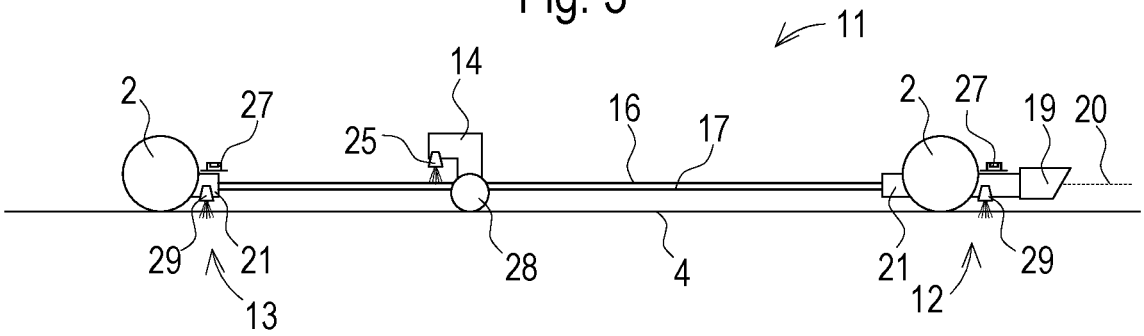

In FIG. 3, the measuring chords 16, 17 are arranged in a vertical plane. The front measuring device 12 attached to the front on-track undercarriage 2 comprises the laser receiver 19, the inclinometer 27, two position measuring sensors 29 and the clamping device 21 for clamping the measuring chords 16, 17.

Arranged at the rear on-track undercarriage 2 is the rear measuring device 13. This also is designed contact-free relative to the track 5 and is connected to the front measuring device 12 via the stretched measuring chords 16, 17. The measuring device 14 arranged there between is guided on the track 5 by means of flanged rollers 28 and detects the position of the measuring chords 16, 17 by means of the measuring transducer 25.

Figure 4:
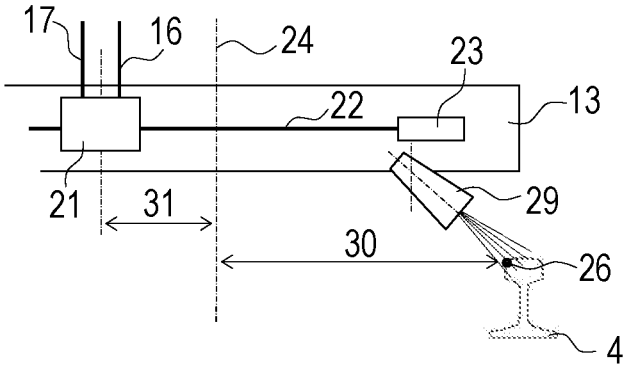

The versine in the track curve can be determined in a simple manner if the front and rear measuring device 12, 13 has in each case a lateral guiding device (lateral tracking according to FIG. 4). To that end, first the position of the measuring device 12 relative to the inner rail 4 is evaluated by means of the position measuring sensor 29 lying at the inside in the track curve. In particular, the position measuring sensor 29 configured as a laser line scanner is designed for two-dimensional detection of the rail surface. From this, by means of the evaluation device 18, a distance 30 to the rail 4 is calculated. Additionally, together with the measuring data of the position measuring sensor lying at the outside in the track curve, the gauge of the track 5 can be detected.

The lateral position of the measuring chords 16, 17 relative to the central measuring device 14 remains unchanged due to the lateral tracking of the clamping device 21 at the front and/or at the rear measuring device 12, 13. To that end, the data of the measuring transducer 25 are continuously evaluated and the motors 23 for lateral tracking are controlled accordingly. From the displacements 31 of the clamping devices 21 and the detected distances 30 to the track 5, it is possible to determine in a known manner the versine of a track curve being travelled through. In addition, the position of the measuring chords 16, 17 relative to the central measuring device 14 is detected and evaluated.

Figure 5:
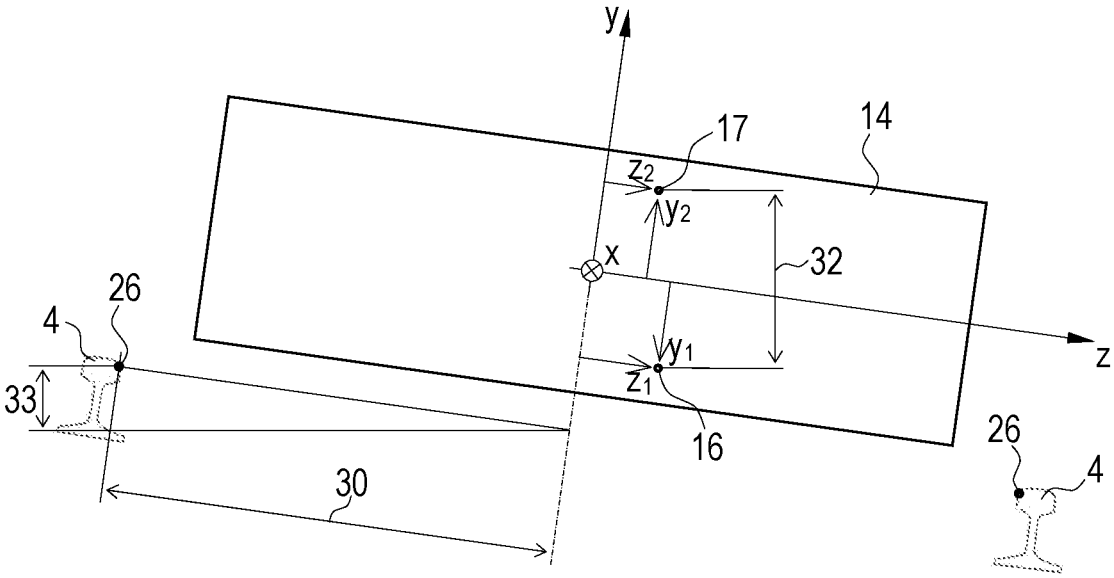

Shown in FIG. 5 are two measuring chords 16, 17 arranged in parallel one above the other, the position of which is detected by means of the measuring transducer 25. Serving as a reference system is, for example, a coordinate system x, y, z tied to the central measuring device 14, wherein the coordinate origin lies above the track center 21. Thus, the longitudinal levels of the rails 4 are determined. Additionally, the detection of the versines is made more precise in connection with the lateral tracking of the outer measuring devices 12, 13.

Starting from a twist of the track 5 which is expressed in detected z-coordinates $z_1$, $z_2$, the longitudinal levels of the rails 4 are determined in a simple manner.

The rail distance 30, the measuring chord distance 32 and the z-coordinates $z_1$, $z_2$ of the measuring chords 16, 17 are known. From this, a relative level 33 of a rail 4 relative to an average longitudinal level of the track 5 results via the following geometric relationship:

$$\text{level}=\text{rail distance}(z_1-z_2)/\text{measuring chord distance}.$$

With the same geometric relationship, it is possible to determine also in a simple manner the super-elevation of a rail 4 by means of the known track gauge. The average longitudinal level of the track 5 can be detected with the y-coordinates $y_1$, $y_2$ of the measuring chords 16, 17. Taking into account the lateral tracking of the outer measuring devices 12, 13, the versine can be determined by means of the z-coordinates $z_1$, $z_2$.

All the described evaluations take place by means of the evaluation device 18 which is designed as a computer and set up for carrying out the calculations. To that end, all the required geometric dimensions of the track maintenance machine 1, such as the distances between the measuring devices 12, 13, 14, can be retrieved from a storage unit. Via a bus system, the computer receives the measurement signals of the position measuring sensors 29, the inclinometers 27 and the measuring transducer 25.

With these data, the computer calculates in real time control signals for controlling the motors 23 for lateral tracking and optionally for inclination compensation of the clamping devices 21. During this, the current displacement paths or displacement angles of the clamping devices 21 are detected and fed back to the computer. With these data and the sensor data, the described computation of the track position takes place.

The invention claimed is:

1. A track maintenance machine for carrying out track position corrections, the track maintenance machine comprising:

undercarriages to be disposed on rails of a track;

a machine frame movable by said undercarriages on the rails;

a track position measuring system including two outer measuring devices, a central measuring device and two mutually aligned measuring chords being tensioned as a reference base between said outer measuring devices;

said measuring devices having positions defined relative to the rails and relative to a longitudinal direction of the machine;

said central measuring device including a measuring transducer for detecting position data of said two measuring chords; and an evaluation device receiving the position data for determining a longitudinal level for each rail and a versine.

2. The track maintenance machine according to claim 1, wherein said two measuring chords are aligned parallel to one another when said outer measuring devices are in a neutral position.

3. The track maintenance machine according to claim 1, wherein each of said outer measuring devices includes a respective inclinometer.

4. The track maintenance machine according to claim 1, wherein each of said outer measuring devices includes a respective inclination compensation device for keeping said two measuring chords in position relative to an axis of rotation extending in a longitudinal direction of the machine.

5. The track maintenance machine according to claim 1, wherein each of said outer measuring devices includes a respective lateral guiding device for keeping said two measuring chords in a track center in a region of said central measuring device during travel in a curve.

6. The track maintenance machine according to claim 1, wherein said measuring transducer is an optical measuring sensor.

7. The track maintenance machine according to claim 1, wherein each of said measuring devices is a respective rail-guided measuring trolley.

8. The track maintenance machine according to claim 1, wherein at least one of said measuring devices is a measuring platform disposed on said undercarriage or on said machine frame and including two position measuring sensors each being associated with a respective rail.

9. The track maintenance machine according to claim 1, which further comprises a track lifting and lining unit being displaceable relative to said machine frame, said central measuring device being disposed on said track lifting and lining unit.

10. The track maintenance machine according to claim 1, wherein the track maintenance machine emits or receives a laser beam, and said two measuring chords are aligned relative to the laser beam.

11. The track maintenance machine according to claim 1, wherein said evaluation device includes a low pass filter for filtering out detected vibrations of a respective one of said measuring chords.

12. A method for operating a track maintenance machine for carrying out track position corrections, the method comprising the following steps:

using undercarriages to move a machine frame on rails of a track;

providing a track position measuring system including two outer measuring devices, a central measuring device and two mutually aligned measuring chords being tensioned as a reference base between the outer measuring devices;

defining positions of the measuring devices relative to the rails and relative to a longitudinal direction of the machine;

using a measuring transducer of the central measuring device to detect position data of the two measuring chords in a region of the central measuring device; and using an evaluation device to receive the position data and to compute a longitudinal level for each rail and a versine.

13. The method according to claim 12, which further comprises detecting an inclination for each of the outer measuring devices and including the inclination in the computing step.

14. The method according to claim 12, which further comprises detecting a lateral displacement for each of the outer measuring devices and including the lateral displacement in the computing step.

15. The method according to claim 12, which further comprises using the evaluation device to attenuate vibrations of a respective one of the measuring chords above a prescribed limit frequency.

* * * * *